United States Patent [19]

Kearns et al.

[11] 3,962,537

[45] June 8, 1976

[54] GUN LAUNCHED RECONNAISSANCE SYSTEM

[75] Inventors: Thomas M. Kearns, Dahlgren; Kenneth D. Ferris, Fredericksburg, both of Va.

[73] Assignee: The United States of America as represented by the Secretary of the Navy, Washington, D.C.

[22] Filed: Feb. 27, 1975

[21] Appl. No.: 553,784

[52] U.S. Cl. ..... 178/6.8; 178/DIG. 1; 178/DIG. 8; 178/DIG. 20; 244/3.14

[51] Int. Cl.[2] ..... H04M 7/02

[58] Field of Search..... 178/6.8, DIG. 1, DIG. 20, 178/DIG. 8; 244/3.14

[56] References Cited

UNITED STATES PATENTS

| | | | |
|---|---|---|---|
| 2,680,578 | 6/1954 | Katz | 244/3.14 |
| 2,717,309 | 9/1955 | Campbell | 325/113 |
| 3,076,189 | 1/1963 | Goddard | 343/6 R |
| 3,143,048 | 8/1964 | Davies | 354/66 |
| 3,160,879 | 12/1964 | Downing et al. | 354/6 |
| 3,269,312 | 8/1966 | Fenton | 102/49.5 |
| 3,721,410 | 3/1973 | Anspacher | 244/314 |
| 3,869,572 | 3/1975 | Carter | 178/7.1 |

*Primary Examiner*—Robert L. Griffin
*Assistant Examiner*—Edward L. Coles

[57] ABSTRACT

The Gun Launched Reconnaissance System provides for the continuous transmission of optical data about a target area to a remote location for a specified period of time. The gun launched projectile housing has mounted therein a forward looking image forming device such as a solid state charge coupled device (CCD) TV camera or infra-red sensor system. Also located in the ballistic round is a video data link system and a deceleration device, such as a parachute-ballute. At a remote terminal is an RF receiver system with a video display unit.

5 Claims, 3 Drawing Figures

GUN LAUNCHED RECONNAISSANCE SYSTEM

BACKGROUND OF THE INVENTION

The Gun Launched Reconnaissance System relates to remote visual observation of a target area.

A problem facing the military is obtaining current reconnaissance information concerning enemy troop strength and deployment, armor and heavy weapons support, damage assessment and other enemy activity. Spotter or forward observers or observation aircraft overflights are currently used.

The Gun Launched Reconnaissance System provides for remotely viewing a battlefield or target area without the risk normally associated with reconnaissance. It could replace the spotter or aircraft, hence avoiding possible loss of life or loss of aircraft. This TV system, also provides a quick reaction capability in target location, identification and damage assessment.

The Gun Lanuched Reconnaissance System will aid a naval gunfire mission in generating relative ship-target position and motion information, in evaluating ballistic factors influencing trajectory and in observing the effects of the firing and correcting the gun orders accordingly. Since the monitoring operator will have direct access to information about where the rounds are landing, there will be a reduction in the number of rounds fired in attempting to reduce the mean point of impact error. With the information from the Gun Launched TV, it will be easier to compensate for other factors affecting gun accuracy, such as meterological data, initial velocity variations and relative target position errors.

Another problem with gun launching a TV system is that the ballistic round achieves high accelerations, sometimes up to 50,000g's. The fragile vidicon tubes used in conventional TV cameras would probably not be able to withstand such force.

SUMMARY OF THE INVENTION

The Gun Launched Reconnaissance System provides for the continuous transmission of optical data about a target area to a remote location for a specified time.

The projectile shaped housing of the gun launched TV is a modified ballistic round. It contains a forward looking image forming device, either video or infra-red, such as a solid state charge coupled device (CCD) TV camera. The housing also contains a video data link and a deceleration device which allows the gun launched TV to descend over the target area at a predetermined rate.

The gun launched TV is propelled from a gun upon a ballistic trajectory until deployment of the deceleration device, such as a parachute-ballute, in order to slow the rate of descent of the housing. Transmission of video is begun upon exit from the gun and is continued throughout most of the flight. The image viewed by the TV camera is continuously transmitted during flight to a remote site where it is directly observed and/or electronically stored for reference.

STATEMENT OF THE OBJECTS OF INVENTION

An object of the invention is to provide a novel means for viewing a target area.

Another object of the invention is to obtain at a remote location, almost instantaneously, a continuous image of a target area.

Another object of the invention is to have a camera system that is gun-launched and capable of withstanding the high acceleration forces.

Other objects, advantages and novel features of the invention will become apparent from the following detailed description of the invention when considered in conjunction with the accompanying drawings.

DETAILED DESCRIPTION OF THE INVENTION

Figure 1:
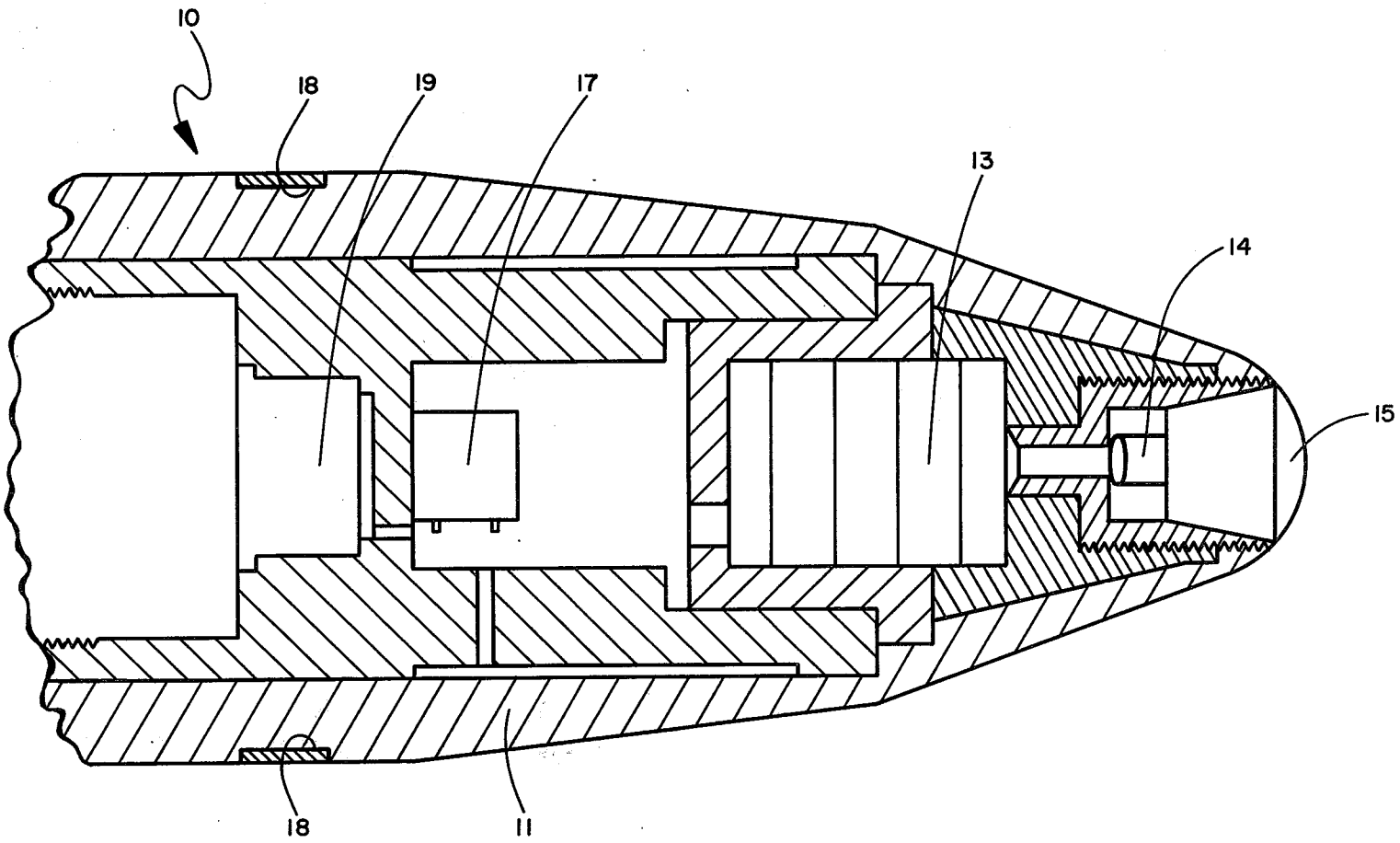
FIG. 1 is a cross sectional view of the nose of the gun launched projectile.
Figure 2:
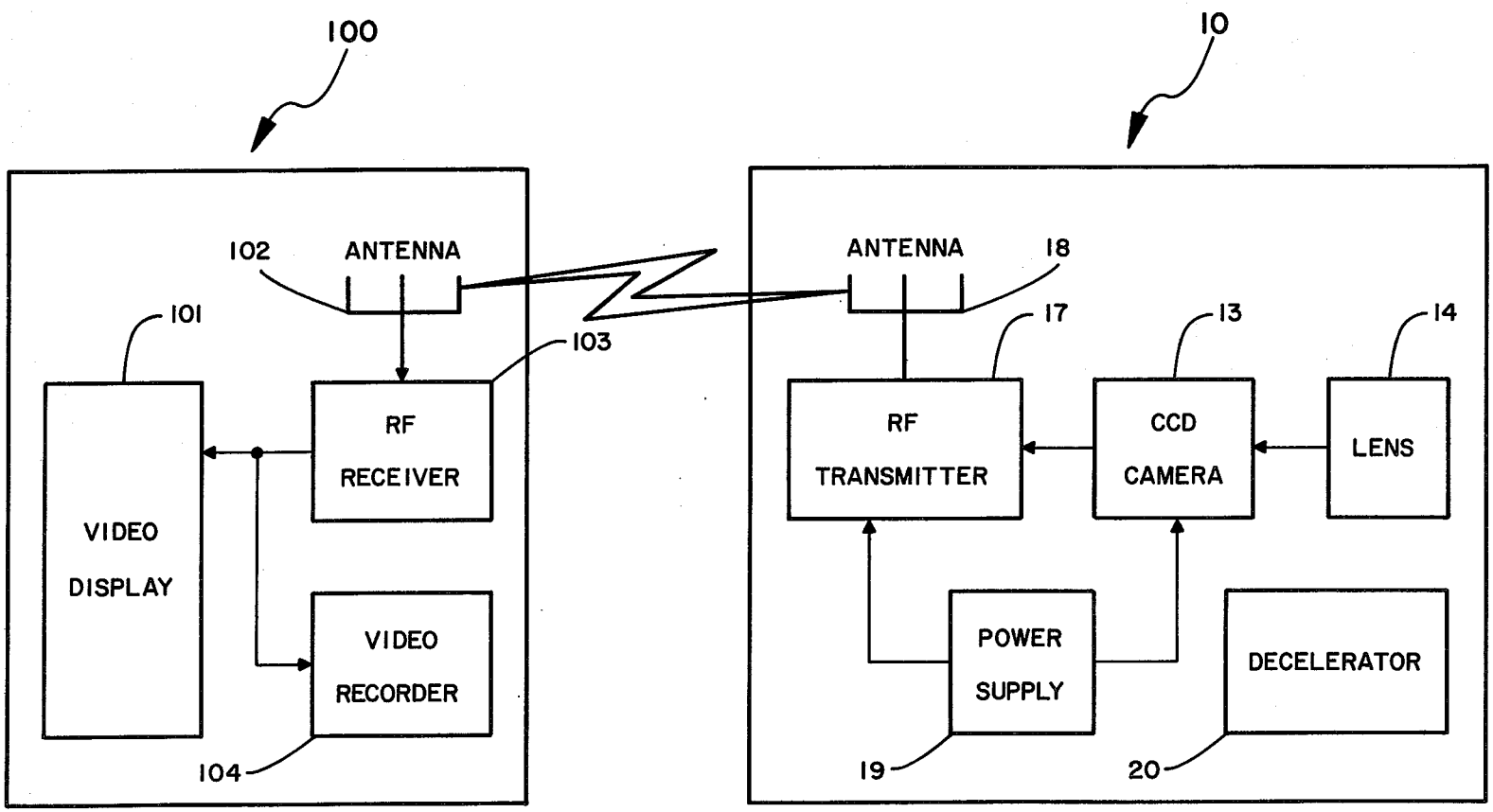
FIG. 2 is a schematic diagram of the system in operation.
Figure 3:
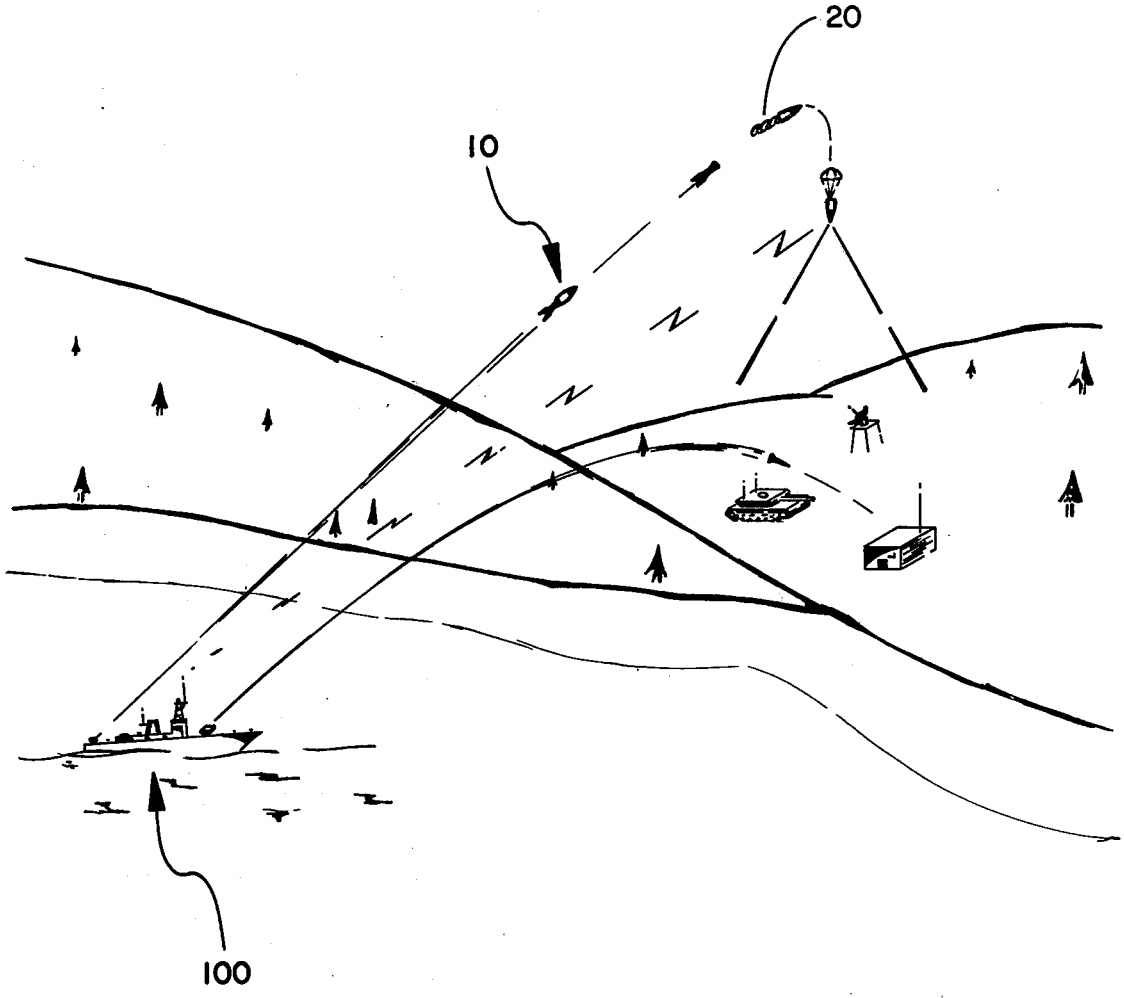
FIG. 3 is a scenario of the gun launched TV system in use.

Referring now to the drawings, the gun launched TV system is described with reference to the subsystems and components which go into the ballistic projectile represented generally by reference numeral 10 and the subsystems for the ground station represented by reference numeral 100.

The ballistic projectile of the 8 inch laser guided projectile (LGP) is modified as a housing 11 so as to hold the TV-RF system. Fins could be deployed or a slip obturating ring used for despin.

For maximization of the detection and recognition probability, given a variety of military targets and target backgrounds, the imaging system in the round is a 100×100 ($10^4$ elements) charge coupled device (CCD) area array. This solid state CCD TV camera 13 converts light quanta into charges that can be stored on a point-to-point basis and then read out in sequence. It does not need however, a complex, power consuming apparatus of a scanning electron beam to so do.

In CCD's the basic charge-coupling principle consists of storing carriers in the inversion regions or potential wells under depletion-biased electrodes, and of moving these carriers from beneath one electrode to beneath the next by appropriate pulsing of the electrode potentials. To do this charge-transfer operation, the neighboring electrodes must be close enough to allow the potential wells between them to couple and the charges to move smoothly from one well to the next.

In imaging, charges are introduced into the device when light from a scene is focused onto the surface of the device. As in all semiconductors, the absorption of light quanta creates hole-electron pairs which, under the influence of the potential beneath each storage electrode, are collected as a charge packet. The quantity of charge thus stored is proportional to the intensity of the image. In this manner, a spatial charge representation of the scene is stored in the device. It is transferred off the device when clock voltages are applied to the electrodes, moving each charge packet serially from storage site to site until all charges reach the output diode.

Because of the projected low light level capability of the CCDs, the TV projectile could be deployed at night. Otherwise, it is possible to replace the TV camera with an infra-red sensor system.

The camera is clocked at thirty frames per second. The CCD camera 13 and optics 14 could be mounted on a gimballed platform to negate any oscillating of the housing 11. A compass could be mounted in the field of view of the camera so that magnetic north would be indicated on the viewing monitor 101.

The lens in the optics 14 is a cemented doublet with a focal length of 24.5mm. A lens cover cap 15 is a clear dome which protects the lens from environmental conditions.

A video RF link is required to transmit a high quality monochrome US commercial standard video signal from the TV projectile 10 to a ground receiving station 100. This portion of the system consists of a RF transmitter 17 and antenna 18 located in the housing. An antenna 102 and an RF receiver 103 with a video display 101 and video recorder 104 are located at the ground terminal 100. The RF video link is a noncrystal controlled 0.25 watt FM transmitter 17 operating at 1.5 GHz and using a strip line wrap around antenna. The transmitter 17, with a 1 MHz bandwidth, consists of the gun hardened Microcom T-7 with a power amplifier on the output. The antenna 18 is omnidirectional in azimuth and is wrapped around and set in the outside of the projectile housing 11. At the monitoring station 100, a narrow beam antenna 102 tracks the projectile to prevent jamming. That is, it would be difficult to get a signal of high enough power into the beam of the antenna to jam the video signal. Also at the ground station 100 is a RF receiver 103 of bandwidth compatible to the type of synchronization used and connected to a video display unit 101 and possibly to a video tape recorder 104.

A thermal battery 19 of a long life (about 30 minutes) is used as the power supply for the CCD camera 13 and transmitter 17. The power supply 19 is activated when it is subjected to the forces experienced along the major axis of the projectile, as it is fired from the 8 inch gun. The means of activation could be a percussion primer or a g-sensitive copper ampule which breaks and distributes the electrolyte.

Selection of the deceleration device is based on a combination of simplicity, space efficiency and the aerodynamic characteristics of stability, opening shock and drag co-efficient. A parachute-ballute 20 system could be mounted in the rear end of the projectile housing 11. After launching, a pre-programmed delay triggers the two foot diameter parachute deployment and slows the projectile down. The seven foot diameter ballute is then deployed to put the housing in a slow descent mode of approximately 15 feet per second. The picture of the area over which it is descending is transmitted to the ground station. If the ballute is metallic coated, the ground station could track it by radar so as to determine its exact position.

The housing could contain an impact fuze to destroy it upon impact and prevent hostile forces from capturing the electronics package.

What is claimed is:

1. A gun launched reconnaissance system for observing and continuously transmitting optical data from a target area to a remote location comprising:

a projectile housing;

a forward looking solid state charge coupled device (CCD) TV camera disposed within the nose of said housing;

a transmitter disposed within said housing and electrically connected to said CCD TV camera for continuously transmitting in real time signals therefrom to a remote location;

a power source electrically connected to said transmitter and to said CCD TV camera; and a means for decelerating said projectile over a target area to extend the period of viewing thereof.

2. The device of claim 1 wherein said solid state CCD TV camera is built with a 100×100 CCD area array.

3. The device of claim 1 wherein said transmitter is a non-crystal controlled FM transmitter using a strip line wrap around antenna.

4. The device of claim 1 wherein said power supply is a long life thermal battery.

5. The device of claim 1 wherein said deceleration device is a parachute-ballute system.

* * * * *